United States Patent [19]

Jürgens

[11] Patent Number: 4,877,403

[45] Date of Patent: Oct. 31, 1989

[54] PROCESS, AND DEVICE FOR FIRING AND BATTLE SIMULATION

[75] Inventor: Lothar Jürgens, Hamburg, Fed. Rep. of Germany

[73] Assignee: Precitronic Gesellschaft fur Feinmechanik und Electronic mbh, Hamburg, Fed. Rep. of Germany

[21] Appl. No.: 239,733

[22] Filed: Sep. 2, 1988

[30] Foreign Application Priority Data

Sep. 3, 1987 [DE] Fed. Rep. of Germany ..... 3729483

[51] Int. Cl.[4] ..... F41F 27/00

[52] U.S. Cl. ..... 434/24

[58] Field of Search ..... 434/16, 24

[56] References Cited

U.S. PATENT DOCUMENTS 4,365,959 12/1982 Caurant et al. ..... 434/24

*Primary Examiner*—William H. Grieb

*Attorney, Agent, or Firm*—Townsend and Townsend

[57] ABSTRACT

The accessory for training simulators is intended especially for the effective practice and monitoring of the work of the loading gunner. A practice cartridge (20) has a device (23) for detecting the actuation of the firing mechanism (9, 10) or an electrical firing signal supplied from outside and a device (24) for emitting an electromagnetic signal when this actuation or the firing signal is detected. Furthermore, the practice cartridge (20) has, on its rear side (7), two electrodes (18, 19) which can be bridged by the striking pin (9) and of which one (19) is connected to the device (23) for detecting the actuation of the firing mechanism (9, 10) or the electrical firing signal supplied from outside and the other (18) is connected via a switch (21) to a battery (22) arranged in the practice cartridge (20). The electromagnetic signal is detected and transmitted by a receiver (32) arranged at the barrel muzzle.

15 Claims, 1 Drawing Sheet

PROCESS, AND DEVICE FOR FIRING AND BATTLE SIMULATION

DESCRIPTION

The invention relates to a process and an accessory intended for carrying out the process, for firing-training simulators.

The object of the invention is to make it possible to ensure especially effective and realistic training on firing and battle simulators.

In the process and accessory mentioned in the introduction, the solution according to the invention is that, for the purpose of obtaining the participation of the loading gunner, a practice cartridge has to be loaded into the weapon, thus necessitating the participation of the loading gunner during training and practice, because the practice cartridge acts as a link between the existing firing devices of the weapon system and the firing-training simulation system installed on this weapon system for practice purposes, the firing initiators of the real weapon system, such as, for example, striking-pin ignition or electrical ignition, activating the practice cartridge, and, according to the process, the latter making a signal connection to elements of the firing-training simulation system, and the manipulations to be executed during the real course of action of the loading gunner are necessitated by the process according to the invention and by the accessory necessary for carrying out the process.

Equipment for firing training, especially that producing directed laser beams for the simulation of a hypothetical projectile, require a continuously improved ergonomic adjustment of all the courses of action of the crew to be trained. To make it possible to practice under realistic conditions, it is not only necessary to simulate an actually fired shot for the gunner in the most effective possible way. On the contrary, especially where firing sequences are concerned, the working efficiency of the loading gunner in the crew should also be exercised and evaluated, although hitherto this has been ignored. Thus, it is known to include the loading gunner in the course of action by incorporating a cartridge of projectile simulation. However, this is effectively possible only when a check can also be made as to whether the loading gunner has inserted the projectile simulation at all at the correct moment and not simply inserted and/or taken out a projectile simulation only from time to time and without coordination with the simulated shots.

A further object of the invention is to provide an accessory for training simulators, by means of which the activity of the loading gunner too can be exercised and monitored in a highly effective way.

This object alone per se is already of inventive quality, since there has hitherto been the prejudice that, in firing simulation, the loading gunner does not have to be taken into particular account.

In a further solution according to the invention, the accessory is a practice cartridge which contains a device for detecting either the actuation of a firing mechanism or an electrical firing signal supplied from outside, a device for emitting an electromagnetic or acoustic signal when this actuation or the firing signal is detected and, on its rear side, two electrodes which can be bridged by the firing pin and of which one is connected to the device for detecting the actuation of the firing mechanism or the electrical firing signal supplied from outside and the other is connected to a battery via a switch, and it has a receiver for receiving and transmitting the electrical signal.

The practice cartridge is used in essentially the the same way as an actual cartridge. By "cartridges" are meant, here, not only relatively small cartridges, but also entire projectiles together with their cartridge. The practice cartridge also detects the normal actuation of the firing mechanism, that is to say the contact by the firing pin and/or the reception of an electrical ignition voltage at this point. As soon as it has detected actuation of the firing mechanism, it emits an electromagnetic signal which is detected by the receiver arranged at the barrel muzzle and which is transmitted, for example, via appropriate lines.

However, an absolutely essential feature is that the practice cartridge has, on its rear side, two electrodes which can be bridged by the firing pin and of which one is connected to the device for detecting the actuation of the firing mechanism and the other is connected via a switch to a battery arranged in the practice cartridge.

The practice cartridge can thus be used for different simulators or firing devices. If the firing device has a striking pin which, by means of its mechanical energy, causes an ignition capsule to detonate in actual cartridges or projectiles, the practice cartridge is previously set so that one of the electrodes is connected via the switch to the battery arranged in the practice cartridge. The voltage of this battery is then transmitted, as a result of bridging by the striking pin, to the other electrode, from which it enters the device for detecting the actuation of the firing mechanism. Thus, when the striking pin reaches the practice cartridge, that is to say strikes the electrodes, the actuation of the firing mechanism is detected and the signal corresponding to the simulated shot is emitted.

In many firing devices, however, there is already a provision for the striking pin or a similar element to receive the voltage of the battery. In this case, the switch inside the practice cartridge is previously opened, so that one electrode is no longer connected to the battery arranged in the practice cartridge. This electrode is inactive in this case. But when the striking pin bridges the electrodes, that is to say touches the other electrode, the voltage of the external battery is applied to the device for detecting the actuation of the firing mechanism, so that the signal of a simulated shot can be emitted again.

Thus, the practice cartridge can be used for two different types of firing devices simply by changing over a switch. A third type of firing device for actual guns also has a surge generator which is used when the battery voltage fails. By means of this surge generator, instead of a battery voltage of, for example, 15 volts, a voltage surge of approximately 150 volts is generated, and this can then likewise be used for igniting the ignition capsule. Such surge generators provided only for emergencies are based on electrical induction in a coil in response to jerky rapid movement of permanent magnets. Such surge generators are known per se and will therefore not be described in detail here.

When firing is also to be practiced with this surge generator, according to the invention the practice cartridge will have a capacitor and stabilizing circuit for detecting both electrical low-voltage firing pulses and voltage firing pulses from a surge generator. Whereas, with an actual cartridge, it does not matter whethere there is the necessary ignition voltage of approximately 15 volts or the approximately ten times higher voltage from a surge generator, in the practice cartridge it is very important, of course, that no excessively high voltage be applied to the voltage detector. The capacitor and stabilizing circuit ensures, here, that the high and short voltage pulse from the surge generator is transformed accordingly.

Consequently, in each of the three firing or ignition mechanisms mentioned, a voltage is applied to the detector at least for a certain time. This voltage can then also be used to generate the signal, so that no separate voltage supply is required for the practice cartridge.

The signal could be, for example, a radio signal. It is especially expedient, however, if the signal is a light signal. The light can therefore be generated by means of a light-emitting diode (LED).

Advantageously, there is a device for coding the signal to be emitted, especially the light signal. The signal can be coded with the firing time and with the type of ammunition.

In order to monitor realistic loading, in an advantageous embodiment the practice cartridge has a resetting switch which, until it is actuated, prevents a second signal from being emitted after a first one. The practice cartridge therefore emits only a single signal. If the firing device is actuated a second time, the practice cartridge emits no further signal. Only when the loading gunner has extracted the practice cartridge again and reinserted it can a further signal be emitted, if the resetting switch has previously been actuated. At the same time, the resetting switch can be designed as a switch which is to be actuated by the loading gunner and which the loading gunner can actuate only when he has taken the practice cartridge out of the gun. However, the switch can also be designed so that it causes a resetting automatically when the practice cartridge is taken out of the gun or reintroduced. A mechanically actuated switch or an electronically actuated switch could be used for this purpose. Furthermore, there can be a timer which makes it possible to emit a second signal only when the switch is actuated after the time technically predetermined thereby.

Moreover, there can be an automatic device which ensures that a coded signal identifying the type of cartridge etc. is emitted immediately whenever the cartridge is used. As a result, for example, the simulator can be set automatically to the type of projectile. Also, it is thus possible to record centrally which projectiles have been loaded, but not yet fired.

The invention is described below by way of example by means of an advatnageous embodiment with reference to the accompanying figures, in which.

Figures 1, 2, 3, 4:
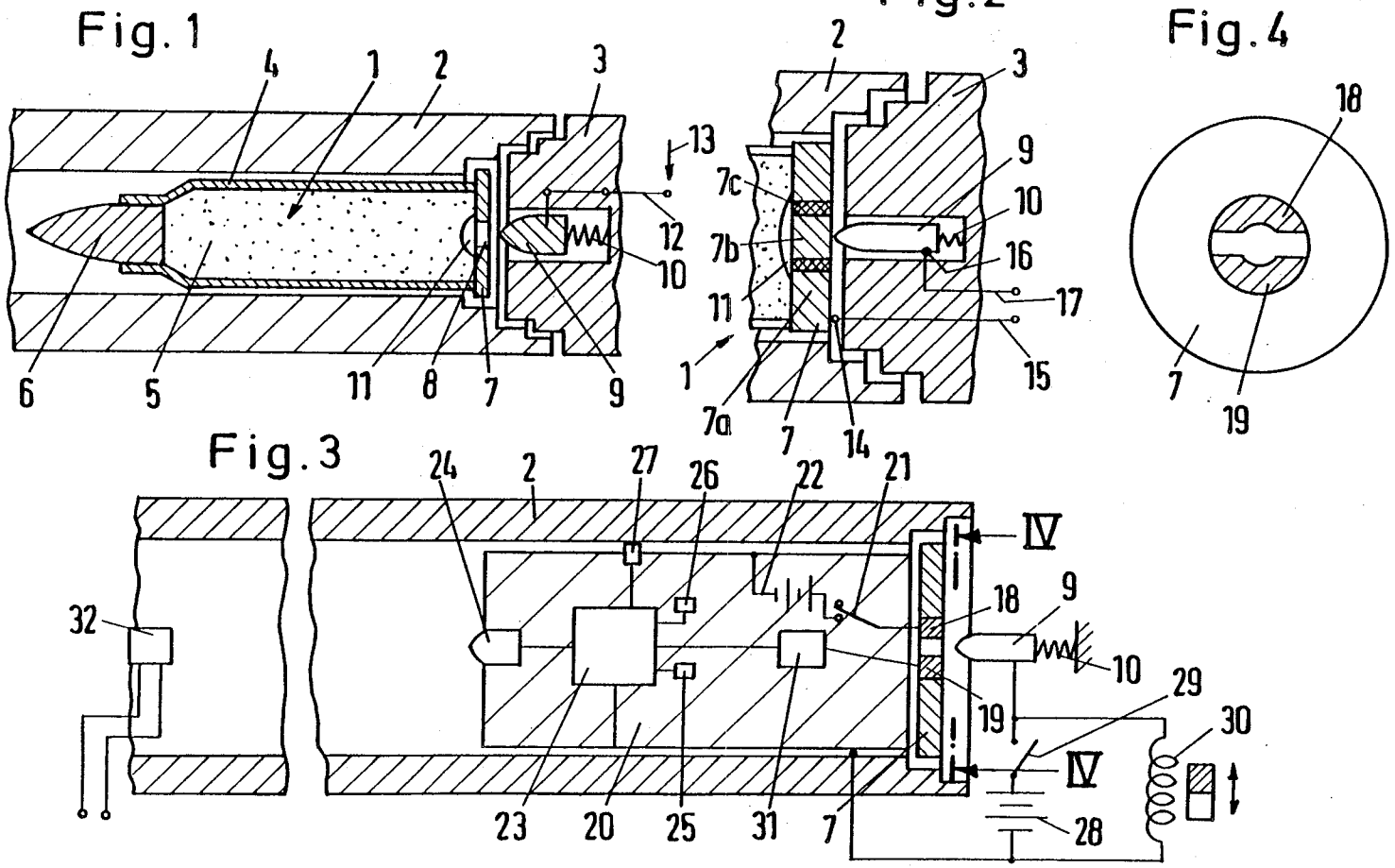
FIG. 1 shows the essential parts of a conventional firing device in a diagrammatic representation and in cross-section.
FIG. 2 shows parts of another firing mechanism in cutout form, but otherwise in a cross-sectional representation similar to that of FIG. 1.
FIG. 3 shows a basic circuit diagram of the practice cartridge according to the invention and of the parts of the simulation device which are connected thereto.
FIG. 4 shows a rear view of the practice cartridge according to the invention, as seen in the direction IV—IV of FIG. 3.

FIG. 1 illustrates a cartridge 1 which is actually used for real firing and which is located in the chamber 2 of a gun closed off at the rear by means of a breach 3. The cartridge 1 has a casing 4 which encloses the propellant. The projectile 6 is located on the cartridge 1 at the front, and at the rear the latter is closed off by means of a plate 7, the middle region 8 of which can be reached by a striking pin 9 of the firing device. When the striking pin 9 accelerated as a result of the force of a spring 10 strikes this middle region 8, it causes the ignition capsule 11 located in this region to detonate, as a result of which the propellant 5 is then ignited. So that the striking pin 9 can initially be maintained in its cocked position, it is equipped with an appropriate recess, behind which a trigger mechanism indicated at 12 engages. When this trigger mechanism 12 is actuated in the direction of the arrow 13, the striking pin 9 can shoot to the left and ignite the cartridge.

In the firing mechanism of FIG. 2, instead of a striking pin there is a pin 9 which is likewise pressed against the rear side of the cartridge 1 by a spring 10. Here, however, the ignition energy is not mechanical, but electrical. For this purpose, the rear wall 7 of the practice cartridge 1 has an outer conductive region 7*a* and a middle conductive region 7*b* which are separated from one another by means of a ring 7*c* made of insulating material. The ignition charge 11 to be ignited electrically is on the left of the middle conductive region 7*b* in FIG. 2. The outer conductive region 7*a* is connected to an electrical line 15 via a contact 14. The pin 9 is connected to a further line 17 via a contact 16. When a voltage is applied to the lines 15 and 17, the ignition charge 11 and consequently the cartridge are ignited. The voltage can come from a battery via a trigger switch or else from a surge generator.

FIG. 3 illustrates the practice cartridge according to the invention. Here, the mechanical part of the ignition mechanism is represented merely by the pin 9 and the spring 10.

The practice cartridge possesses, on its rear wall 7, two electrodes 18 and 19 which, for example, can be essentially semircircular with a central likewise semicircular recess, as illustrated in FIG. 4. At the same time, the rear wall 7 of the practice cartridge 20 is otherwise made essentially, but at all events in the region of the electrodes 18 and 19, of insulating material.

One electrode, in particular the electrode 18, is connectable via a switch 21 to a battery 22 arranged in the practice cartridge. The other electrode, in particular the electrode 19, is connected to an electronic circuit 23 which, when a voltage is applied to the electrode 19, excites a light-emitting diode 24 into at least brief illumination. The energy supply for the light-emitting diode 24 is obtained here from the voltage which is applied to the electrode 19. Connected to the circuit 23 is another circuit 25 which codes the signal from the LED 24, via the circuit 23, with the clock time of the simulated shot, that is to say of the voltage signal. The light signal is coded with the type of ammunition by means of a further device 26. A resetting switch 27 which can be, for example, a mechanical microswitch ensures that a further signal can be emitted only when this microswitch is previously actuated, that is to say the practice cartridge has been tken out of the gun.

If the practice cartridge 20 is to be actuated by means of the firing device of FIG. 1, the switch 21 inside the practice cartridge 20 is previously closed. The electrodes 18 and 19 are then bridged by the striking pin 9 and consequently the voltage from the battery 22 is applied to the circuit 23 which then causes the LED 24 to emit the light signal.

If the practice cartridge is to be used in a firing device according to FIG. 2, that is to say if a voltage signal from a battery 28 is to be applied to the pin 9 from outside via a trigger switch 29, the switch 21 is opened; the electrode 18 is then inactive. At the moment of the simulated shot, the voltage from the battery 28 is then applied to the circuit 23 via the pin 9 and the electrode 19, so that the LED 24 is excited to emit the light signal. If firing is to be practiced with a surge generator 30 which emits a substantially higher voltage than the battery 28, in the capacitor and stabilizing circuit 31 which is arranged in the practice cartridge 20, the signal from the surge generator 30 is first reduced in size and lengthened in terms of its time duration, so that a signal applied to the circuit 23 has approximately the same voltage as the battery 28 and, moreover, a time duration sufficient to ensure that the LED 24 can emit light signal for a long enough period.

I claim:

1. A practice cartridge for use in simulating firing in a firing system having a firing mechanism including an electrically conductive pin, the practice cartridge comprising:

a cartridge body having a breach-facing wall, the body being sized to fit within the firing system;

first and second spaced apart electrically conductive electrodes disposed on said breach-facing wall a distance apart less than a transverse dimension of the pin in the firing mechanism;

means for providing a voltage within the cartridge body;

said first electrode being switchably connected to said means for providing when the firing mechanism includes a pin unconnected to an external voltage source, such that actuating the firing system causes the pin to complete an electric circuit between the first and second electrodes thereby providing a voltage to the second electrode;

said first electrode being switchably disconnected from said means for providing when the firing mechanism includes a pin connected to an external voltage source, such that actuating the firing system causes the pin to contact said second electrode thereby providing a voltage to the second electrode;

means, disposed within the cartridge body, for detecting the presence of a voltage on said second electrode, the detected voltage signaling the firing of the system.

2. The cartridge of claim 1, wherein the firing system is an actual gun.

3. The cartridge of claim 1, wherein the firing system is a simulator.

4. The cartridge of claim 1, further including means, disposed within the cartridge body, for emitting an electromagnetic signal when a voltage is detected on said second electrode by said means for detecting.

5. The cartridge of claim 4, wherein the means for emitting an electromagnetic signal includes a light emitting diode.

6. The cartridge of claim 4, further including a receiver, disposed within the cartridge body, for receiving the electromagnetic signal emitted by said means for emitting.

7. The cartridge of claim 4, further including reset means, disposed within the cartridge body, for activating said means for detecting when the cartridge is inserted into the system and for deactivating said means for detecting after a voltage on the second electrode has been detected.

8. The cartridge of claim 7, further including a timer to prevent said reset means from being reset earlier than a predetermined amount of time.

9. The cartridge of claim 1, further including means, disposed within the cartridge body, for emitting an acoustic signal when a voltage is detected on said second electrode by said means for detecting.

10. The cartridge of claim 4, further including means for encoding said electromagnetic signal.

11. The cartridge of claim 10, wherein said means for encoding encodes a time of firing of the system and a type of ammunition simulated by the cartridge.

12. The cartridge of claim 10, further including means for emitting an encoded signal when the cartridge is loaded in the system.

13. The cartridge of claim 10, futher including stabilizing means, connected between said second electrode and said means for detecting, for permitting the cartridge to function with a firing mechanism that includes a surge generator.

14. The cartridge of claim 13, wherein said stabilizing means includes a capacitor.

15. The cartridge of claim 4, wherein a voltage from the firing mechanism at the second electrode provides electrical power to said means for detecting and said means for emitting.

* * * * *